US011565917B2

(12) United States Patent
Gevaudant et al.

(10) Patent No.: US 11,565,917 B2
(45) Date of Patent: Jan. 31, 2023

(54) SELF-ERECTING CRANE COMPRISING A REMOVABLE BALLASTING ELEMENT FOR A TRANSPORT ON A FIFTH WHEEL

(71) Applicant: MANITOWOC CRANE GROUP FRANCE, Dardilly (FR)

(72) Inventors: Olivier Gevaudant, Marcy l'Etoile (FR); Fabrice Thomas, L'Arbresle (FR); Eric Millet, Saint-Symphorien de Lay (FR)

(73) Assignee: Manitowoc Crane Group France, Dardilly (FR)

( * ) Notice: Subject to any disclaimer, the term of this patent is extended or adjusted under 35 U.S.C. 154(b) by 0 days.

(21) Appl. No.: 17/216,571

(22) Filed: Mar. 29, 2021

(65) Prior Publication Data

US 2021/0300733 A1 Sep. 30, 2021

(30) Foreign Application Priority Data

Mar. 30, 2020 (FR) ..... 20/03113

(51) Int. Cl.
*B66C 23/34* (2006.01)
*B66C 23/76* (2006.01)

(52) U.S. Cl.
CPC ..... *B66C 23/346* (2013.01); *B66C 23/76* (2013.01)

(58) Field of Classification Search
CPC ..... B66C 23/34; B66C 23/344; B66C 23/346; B66C 23/76
See application file for complete search history.

(56) References Cited

U.S. PATENT DOCUMENTS

2004/0221673 A1* 11/2004 Mojzis ..... B66C 23/344 74/469

FOREIGN PATENT DOCUMENTS

| | | | | |
|---|---|---|---|---|
| DE | 19856593 A1 * | 6/1999 | ..... | B66C 23/34 |
| EP | 3141517 A1 * | 3/2017 | ..... | B66C 23/344 |
| FR | 89990 E | 9/1967 | | |
| FR | 3040990 B1 * | 10/2017 | ..... | B66C 23/344 |
| GB | 798547 A | 7/1958 | | |

(Continued)

OTHER PUBLICATIONS

DE 19856593 A1 Machine Translation (Year: 1999).*

(Continued)

*Primary Examiner* — Michael R Mansen
*Assistant Examiner* — Juan J Campos, Jr.
(74) *Attorney, Agent, or Firm* — Cook Alex Ltd.

(57) ABSTRACT

A self-erecting crane including a mast mounted on a rotating platform and supporting a boom is configurable between a transport configuration and a working configuration. The mast supports a hitch element suitable for being coupled on a fifth wheel provided on a rear platform of a tractor truck, the hitch element being located in a front hitch area of the mast which is dimensioned to come above the rear platform. The self-erecting crane also includes a mooring system located on the front hitch area and a removable ballasting element. In the transport configuration, the removable ballasting element is configured to be temporarily moored on the mast by the mooring system so that the removable ballasting element is located under the mast in the front hitch area. In the working configuration, the removable ballasting element is mounted on the rotating platform.

23 Claims, 11 Drawing Sheets

(56) References Cited

FOREIGN PATENT DOCUMENTS

| | | | | |
|---|---|---|---|---|
| WO | WO-9929614 A1 * | 6/1999 | ..... | B66C 23/34 |
| WO | 01/44097 A1 | 6/2001 | | |

OTHER PUBLICATIONS

WO 9929614 A1 Machine Translation (Year: 1999).*
EP 3141517 A1 Machine Translation (Year: 2017).*
FR 3040990 B1 Machine Translation (Year: 2017).*
WO 0144097A1 Machine Translation (Year: 2001).*
Search Report and English translation of Written Opinion issued by the French Patent Office in connection with corresponding French Application No. FR2003113, dated Dec. 7, 2020.

* cited by examiner

SELF-ERECTING CRANE COMPRISING A REMOVABLE BALLASTING ELEMENT FOR A TRANSPORT ON A FIFTH WHEEL

FIELD

The invention relates to a self-erecting crane, as well as a method for transporting such a crane.

It relates more particularly to the field of self-erecting cranes, also called convertible cranes, foldable cranes or transportable tower cranes, which conventionally comprise a mast (also called a tower) which is mounted on a rotating platform and supporting a boom (also called a distributing boom as equipped with a movable distribution trolley and supporting a hook for lifting a load), such a self-erecting crane being configurable between a transport configuration wherein the mast and the boom are folded back on themselves, and a working configuration wherein the mast and boom are unfolded to execute load distribution and lifting operations.

BACKGROUND

In a known manner, such a self-erecting crane, once in the transport configuration, is transported by road, by means of a tractor truck, generally a trailer truck or a semi-trailer truck. Also, the self-erecting crane is conventionally mounted on one or several wheel-carrying axle(s).

In a first embodiment, the axle(s) can be disassembled and are fastened to the rotating platform, in general one at the front and one at the rear, and they are thus disassembled when the crane is in the working configuration.

In a second embodiment, the axle(s) is/are permanently fastened to a chassis on which the rotating platform is mounted, and thus the axle(s) participates/participate in the stability of the crane in the working configuration. In this second embodiment, the rotating platform is therefore mounted on a chassis supporting at least one set of crane wheels, generally with single axle or double axles, and it is conventional that this chassis is equipped with a wedging system comprising one or several wedging means, generally in the form of a hydraulic cylinder, suitable for bearing on the ground and thus for taking off the set of crane wheels to stabilize the crane in the working configuration.

Two transport methods can thus be considered:

- a transport on a fifth wheel, wherein the crane supports a hitch element provided with a hitch shaft suitable for being coupled on a fifth wheel of a tractor truck (of the semi-trailer type), this fifth wheel being provided on a rear platform of the tractor truck, which rear platform resting on at least one set of rear wheels of the tractor truck, and thus the front of the crane rests on the rear platform of the tractor truck, while the rear of the crane rests on the set of crane wheel s which is mounted under the rotating platform;
- a transport on a drawbar, wherein the crane supports a towing drawbar (or tow bar) suitable for being coupled to a towing element of a tow truck (of the trailer type), and thus the crane is towed by the tow truck and rests on the set of crane wheels which is mounted under the rotating platform.

In the working configuration, it is necessary and conventional to have ballasts on the rotating platform, in order to stabilize the crane and provide a load capacity essential for the load lifting operations which are provided by the crane. However, in the transport configuration, these ballasts are located on the rotating platform, therefore at the rear of the convoy (whether in the transport on a fifth wheel or in the transport on a drawbar) and therefore above the set of crane wheel, this which limits the admissible mass thereof and unloads the front of the crane, a phenomenon which can deteriorate the behavior of the convoy on the road.

SUMMARY

Thus, the invention proposes to provide a solution to this dual problem: ballasting the rotating platform in the working configuration to increase the load curve of the crane in service, and improving the stability of the convoy on the road, more particularly in the context of a transport on a fifth wheel.

To this end, the invention proposes a self-erecting crane comprising a mast which is mounted on a rotating platform and supporting a boom, this self-erecting crane being configurable between a transport configuration wherein the mast and the boom are folded back on themselves, and a working configuration wherein the mast and the boom are unfolded, this mast supporting a hitch element provided with a hitch shaft suitable for being coupled on a fifth wheel provided on a rear platform of a tractor truck in the transport configuration, said rotating platform being located in the transport configuration at the rear of the mast while the hitch element is located at the front of the mast in a front hitch area which is dimensioned to come above the rear platform of the tractor truck for a transport on a fifth wheel, and wherein the rotating platform is mounted on a chassis supporting at least one set of crane wheels, said self-erecting crane being remarkable in that it comprises a mooring system located on the front hitch area of the mast, such that this mooring system is located on the underside of the mast in the transport configuration, and in that it comprises at least one removable ballasting element which is configured to be:

- in the transport configuration, temporarily moored on the mast by means of the mooring system, so that this removable ballasting element is located under the mast on the front hitch area of the mast, and
- in the working configuration, mounted on the rotating platform.

Thus, in the working configuration, this removable ballasting element is mounted on the rotating platform and therefore contributes to the increase in the load curve of the crane. Moreover, in the transport configuration, this removable ballasting element is placed on the front hitch area of the mast, and therefore is necessarily placed above the rear platform of the tractor truck, in the vicinity of the hitch element which cooperates with the fifth wheel. In this manner, during the transport on the fifth wheel, the removable ballasting element allows loading the front of the crane, at the rear platform of the tractor truck, which will contribute to balance the loads and increase the load on the set of rear wheels (or rear axle) of the tractor truck, and therefore increase the adhesion of the convoy without increasing the load on the set of crane wheel.

It should be noted that the mooring system is fastened on the mast, in the front hitch area of the mast, and that this mooring system can be permanently fastened on the mast, or alternatively be fastened in a removable or detachable manner on the mast. In the case where the mooring system is permanently fastened on the mast, the function of mooring the removable ballasting element on the front hitch area of the mast is still present, without being always used. However, if the mooring system is removably or detachably fastened on the mast, then this function is an option which can be added or removed from the crane.

Moreover, it should be noted that the concepts of front and rear refer to a relative positioning in a horizontal advance direction in a straight line, with the front closer to the tractor or tow truck than the rear. The concepts of above and below refer, in turn, to a relative positioning in a vertical direction, with the underside located lower (or closer to the ground) than the upper side, or with the underside facing the ground compared to the upper side which is facing the sky.

According to a first possibility, the mooring system is located in front of the hitch element such that, in the transport configuration, the hitch element is located between the rotating platform and the removable ballasting element.

Thus, the removable ballasting element will be located in front of the hitch element, to load the set of rear wheels (or rear axle) of the tractor truck.

According to a second possibility, the mooring system is located behind the hitch element such that, in the transport configuration, the removable ballasting element is located between the rotating platform and the hitch element.

Indeed, the fifth wheel is not located on the rear edge of the rear platform of the tractor truck, but rather is located at a distance from this rear edge. Also, the hitch element will be located substantially in the middle of the front hitch area of the mast, and there is therefore the possibility of placing the removable ballasting element behind the hitch element, while being always located on the front hitch area of the mast to be above the rear platform of the tractor truck during the transport on a fifth wheel, and thus the removable ballasting element will be able to load the set of rear wheels (or rear axle) of the tractor truck.

According to one feature, the mast comprises a lower mast segment which is hinged on the rotating platform, and an upper mast segment which is connected to the lower mast segment by an intermediate hinge, wherein in the working configuration, the lower mast segment and the upper mast segment are vertical in the extension of each other, and in the transport configuration, the lower mast segment and the upper mast segment are horizontal and the upper mast segment is folded back above the lower mast segment, wherein the front hitch area of the mast corresponds to an upper end portion of the lower mast segment, said upper end portion being connected to the upper mast segment opposite to the rotating platform, the hitch element and the removable ballasting element then being fastened below this upper end portion of the lower mast segment in the transport configuration.

Thus, in the transport configuration, the removable ballasting element is moored on the lower mast segment, at the front of the crane, and more specifically on the underside of the upper end portion of the lower mast segment. Therefore, the mooring system is fastened on this upper end portion of the lower mast segment.

According to one possibility, in the transport configuration, the removable ballasting element is located at least partially below the intermediate hinge which is located at the front.

Advantageously, the removable ballasting element comprises a thin ballasting body which, when moored on the mast in the transport configuration, has a thickness measured in a vertical direction, a length measured in a longitudinal direction from front to back, and a width measured in a transverse direction from right to left, wherein the thickness is less than the width and the length.

The thin shape of the removable ballasting element allows indeed not to interfere with the hitching on the tractor truck.

According to another possibility, in the transport configuration, the removable ballasting element is disposed directly in front of the hitch element or directly behind the hitch element, in other words opposite to or facing this hitch element.

According to another possibility, the removable ballasting element comprises at least one mooring member and the mooring system comprises at least one support suitable for supporting the mooring member, said support and said mooring member cooperating with a lock which is configurable between an unlocked position releasing the mooring member of the support in order to be able to unmoor the removable ballasting element, and a locked position locking the mooring member to the support to moor the removable ballasting element on the mast in the transport configuration.

Thus, by acting on the lock(s), it is easy to unmoor and therefore detach the removable ballasting element, or conversely to moor and therefore attach the removable ballasting element on the mast, and if necessary on the lower mast segment.

In a particular embodiment, the removable ballasting element comprises at least two mooring members provided with respective lumens, and the mooring system comprises at least two supports suitable for cooperating with the respective mooring members, and the associated locks comprise locking pins which, in the locked position, pass through both the mooring members and the concerned supports for mooring the removable ballasting element below the mast.

In this manner, the mooring of the removable ballasting element is done by pinning by means of the locking pins.

Advantageously, the lumens are oblong and vertical in the transport configuration, which provides a practical latitude for performing the pinning of the locking pins.

According to one feature, the removable ballasting element comprises two mooring members on the rear and at least one mooring member on the front; this configuration being advantageous for balancing the removable ballasting element.

In a particular embodiment, a detection system is disposed on the mast to detect, during a lifting of the removable ballasting element from ground to the mooring thereof on the mast, when the removable ballasting element is positioned in a mooring position adapted so that the support(s) can cooperate with the mooring member(s) and the corresponding lock(s).

Thus, the detection system allows knows whether the removable ballasting element is in the correct position for the mooring thereof.

According to one possibility, the detection system is provided to detect when the removable ballasting element is positioned in an over-stroke position located above the mooring position, to control an automatic stop of the lifting of the removable ballasting element.

In this manner, if the mooring position has been exceeded (in other words, if the removable ballasting element has been too lifted), the lifting is automatically turned off when the over-stroke position is detected.

According to another possibility, the detection system comprises a rocker arm which is movably mounted on the mast and provided to be pushed by the removable ballasting element when lifting the removable ballasting element, and a mooring sensor provided to detect the presence of the rocker arm in a position corresponding to the mooring position of the removable ballasting element.

The rocker arm can be mounted so as to be slidably and/or rotatably movable, and it is pushed by the removable ballasting element when the latter is lifted, which allows knowing the position of the removable ballasting element by detecting the position of the rocker arm.

Advantageously, the detection system comprises an over-stroke sensor, disposed above the mooring sensor and provided to detect the presence of the rocker arm in a position corresponding to the over-stroke position of the removable ballasting element.

In an advantageous embodiment, the removable ballasting element comprises at least one slinging member for fastening a lifting cable adapted to lift the removable ballasting element from ground.

Thus, the removable ballasting element can be lifted by a lifting cable which is slung (in other words fastened) on the slinging member.

In a particular embodiment, a front auxiliary lifting system is provided to lift the removable ballasting element from the ground to the mooring thereof on the mast, this front auxiliary lifting system comprising a front lifting cable which has a front end adapted to be fastened on the slinging member of the removable ballasting element, which passes through a first pulley provided on the upper mast segment, then which passes through a second pulley provided on the upper mast segment, and which ends in a rear end adapted to be fastened on a fixed point provided on the lower mast segment, such that a partial unfolding of the mast starting from the transport configuration to the working configuration allows the front lifting cable to lift the removable ballasting element from the ground to the mooring thereof on the mast.

Thus, this front auxiliary lifting system exploits the unfolding movement of the mast to lift the removable ballasting element in order to moor it on the mast for the transport configuration, which is particularly advantageous because it uses a single front lifting cable (and properly positioned pulleys) without the need for a dedicated lifting device.

In a particular embodiment, a rear auxiliary lifting system is provided to lift the removable ballasting element from the ground to the rotating platform, this rear auxiliary lifting system comprising a rear lifting cable which has a front end which is adapted to be fastened on a load lifting hook carried by the boom, which passes through at least one main pulley provided on the rotating platform, then which passes through a secondary pulley provided on a jib arm hinged on the rotating platform, and which ends in a rear end which is adapted to be fastened to the slinging member of the removable ballasting element, such that a lifting of the removable ballasting element from the ground to the rotating platform.

Thus, this rear auxiliary lifting system therefore exploits the lifting function of the load lifting hook carried by the boom (function inherent in the crane) to lift the removable ballasting element in order to bring it onto the rotating platform (and therefore participate in the increase in the load curve of the crane for the working configuration, which is particularly advantageous because this requires a single rear lifting cable (and properly positioned pulleys and a jib arm) without the need for a dedicated lifting device; the jib arm being hinged to be able to be positioned above the removable ballasting element which rests on the ground and therefore lift the removable ballasting element up to the rotating platform, then after tilting, be able to be positioned above the rotating platform and therefore lower the removable ballasting element until resting on the rotating platform (or on ballasts which are already present on this rotating platform).

Advantageously, slinging member is vertically aligned, when lifting the removable ballasting element, with the center of gravity of the removable ballasting element.

Thus, the removable ballasting element remains straight when lifting, without risk of tilting.

The invention also relates to a transport method for transporting a self-erecting crane according to the invention, which transport method comprising the following steps of:

- starting from a working configuration, folding back the self-erecting crane to bring it into the transport configuration;
- removing the removable ballast element which is initially mounted on the rotating platform during the working configuration;
- mooring the removable ballast element on the front hitch area of the mast by means of the mooring system;
- coupling the hitch shaft of the hitch element on the fifth wheel of a tractor truck, said fifth wheel being provided on a rear platform of the tractor truck, which rear platform resting on at least one set of rear wheels, such that the removable ballasting element, located on the front hitch area of the mast, is disposed above the rear platform of the tractor truck.

Thanks to this method, and as previously mentioned, the removable ballasting element will increase the load curve of the crane in the working configuration, and will increase the stability of the convoy in the transport configuration during a transport on a fifth wheel.

According to one feature, the step of mooring the removable ballast element comprises a lifting of the removable ballasting element from the ground to the mooring thereof on the mast by a cooperation of the lock(s) with the mooring member(s).

In the embodiment with the front auxiliary lifting system, the lifting of the removable ballasting element takes place as follows:

- fastening the rear end of the front lifting cable on the fixed point provided on the lower mast segment;
- placing the front lifting cable on the first pulley and the second pulley which are provided on the upper mast segment;
- fastening the front end of the front lifting cable on the slinging member of the removable ballasting element which is resting on the ground;
- partial unfolding of the mast starting from the transport configuration to the working configuration, so that the front lifting cable lifts the removable ballasting element.

In the embodiment with the detection system, the lifting of the removable ballasting element takes place at least until the detection system detects when the removable ballasting element is positioned in the mooring position.

Advantageously, the lifting of the removable ballasting element is automatically stopped when the detection system detects when the removable ballasting element is positioned in the over-stroke position.

DRAWINGS

Other features and advantages of the present invention will appear on reading the detailed description below, of a non-limiting example of implementation, made with reference to the appended figures wherein.

Figure 1:
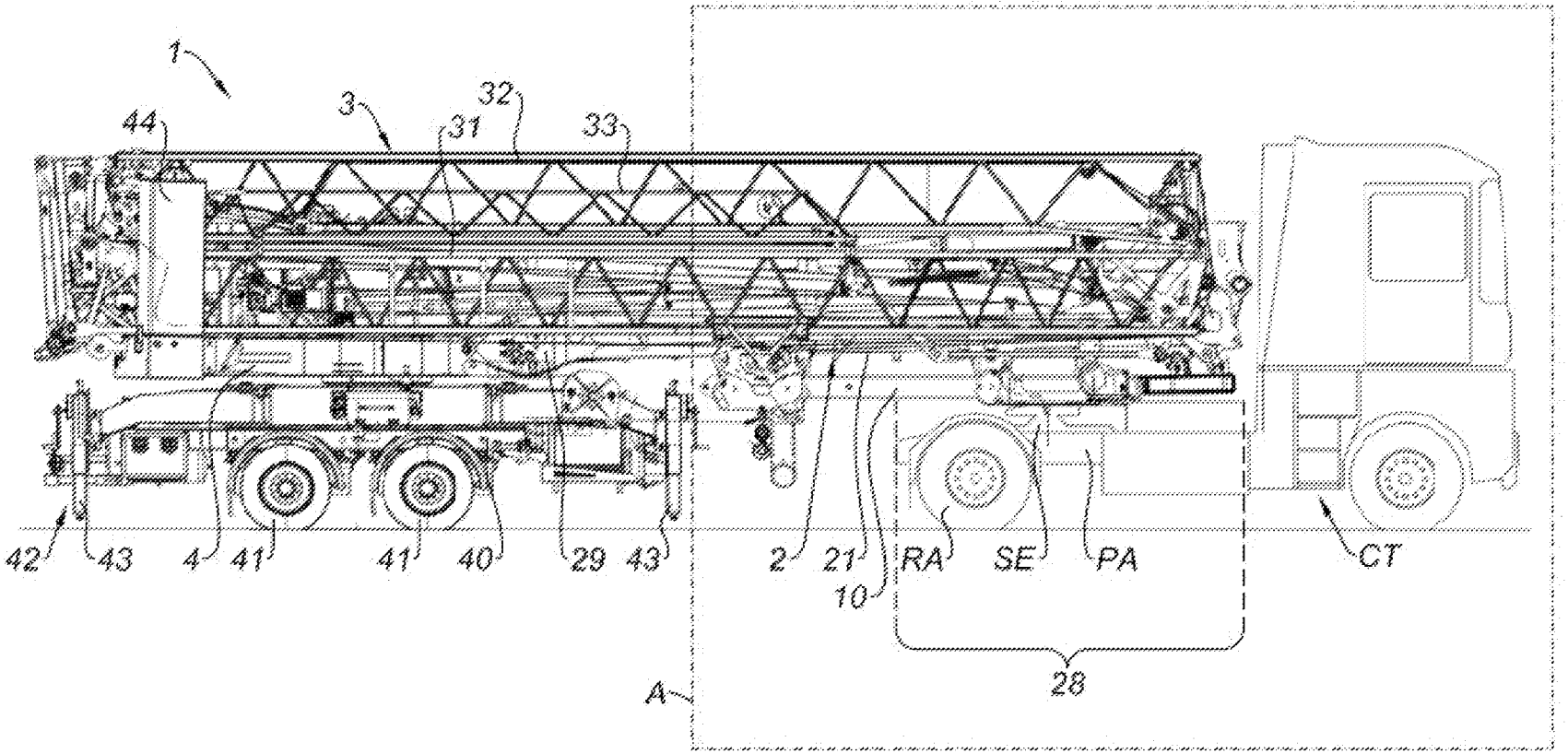
FIG. 1 is a schematic view of a self-erecting crane according to the invention, in the transport configuration, and in the situation of transport on a fifth wheel with a coupling on a tractor truck.
Figure 2:
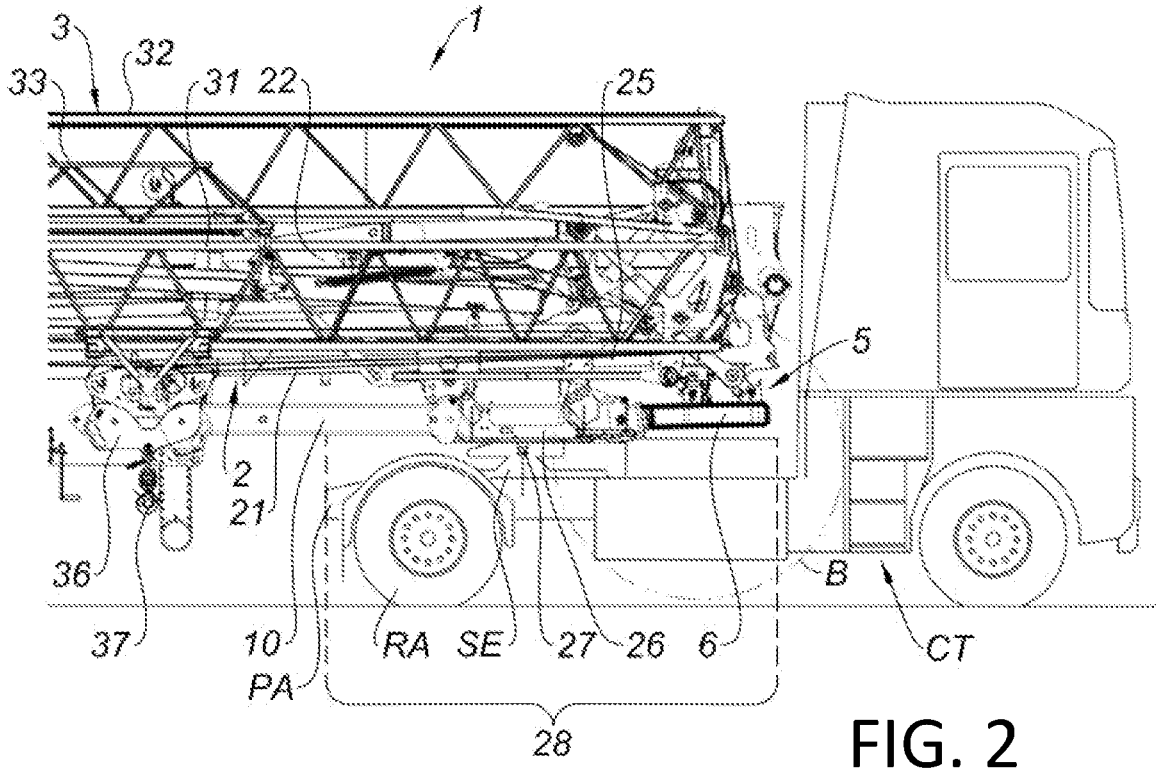
FIG. 2 is a zoomed schematic view on the area A of FIG. 1, to view the front of the crane which is coupled on the tractor truck.
Figure 10:
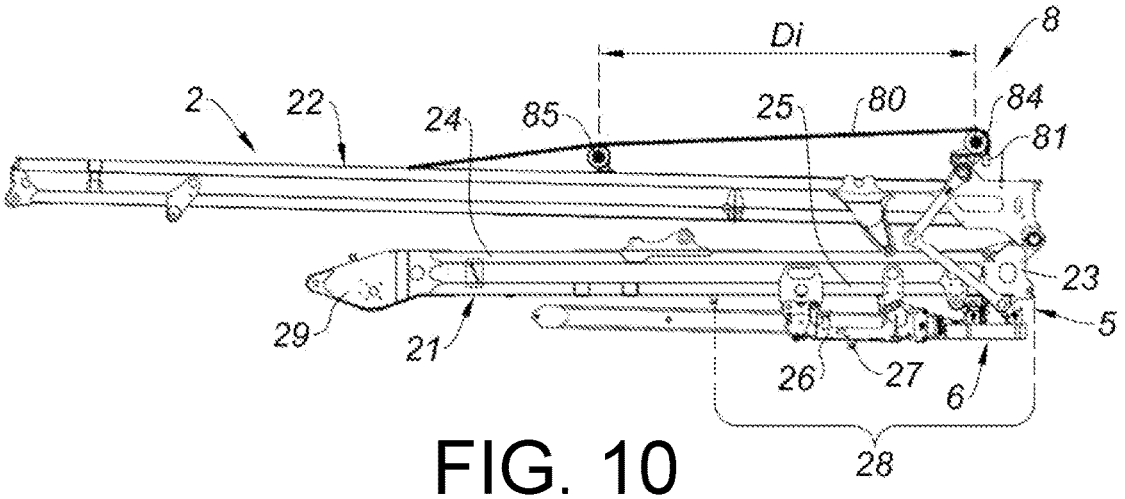
Figure 11:
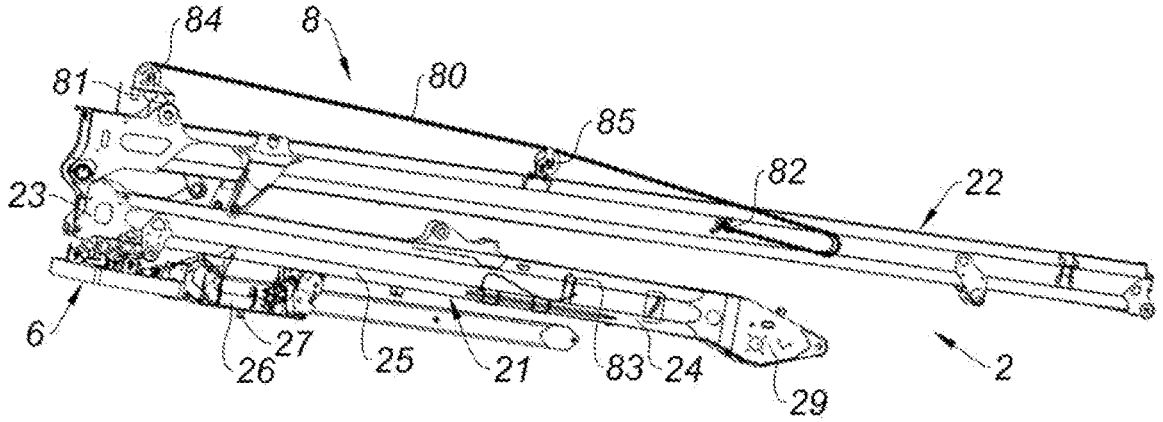
Figure 12:
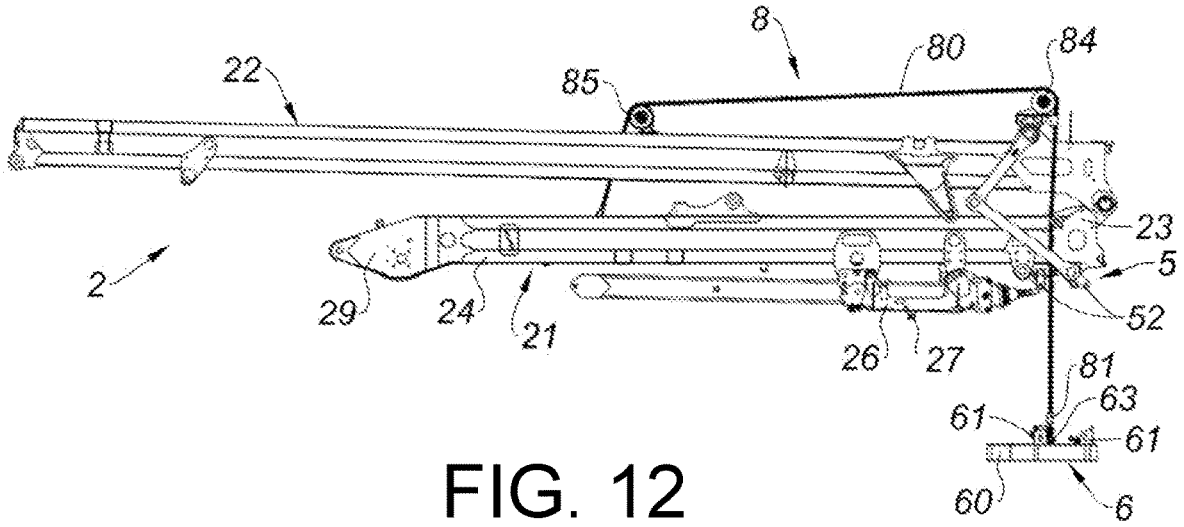
Figure 13:
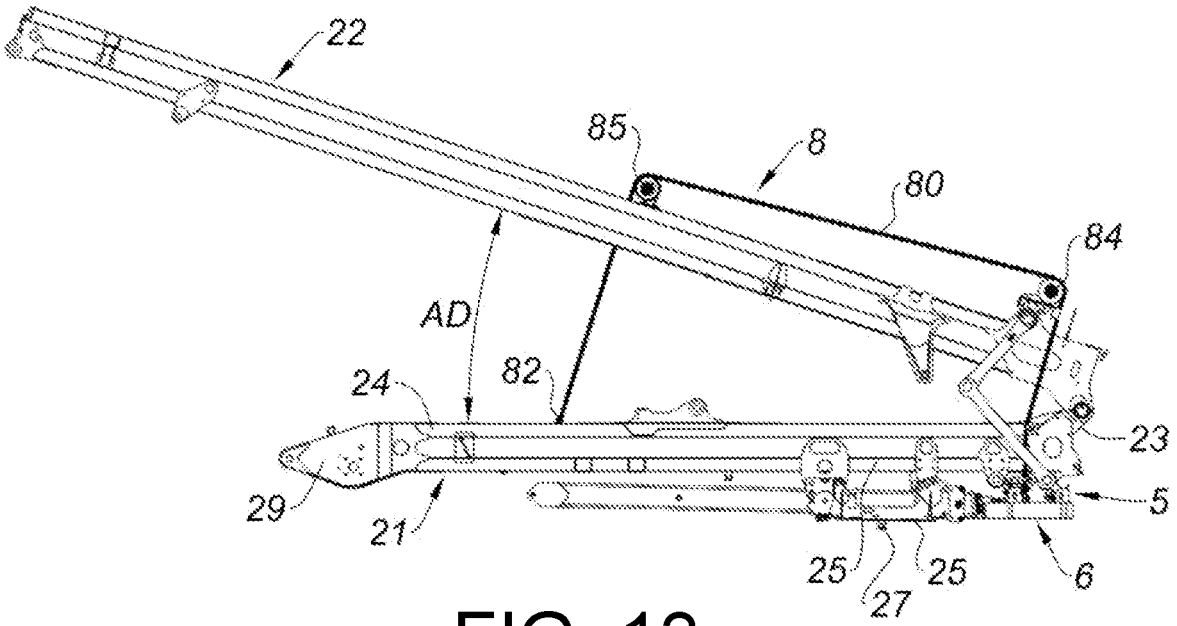
Figure 14:
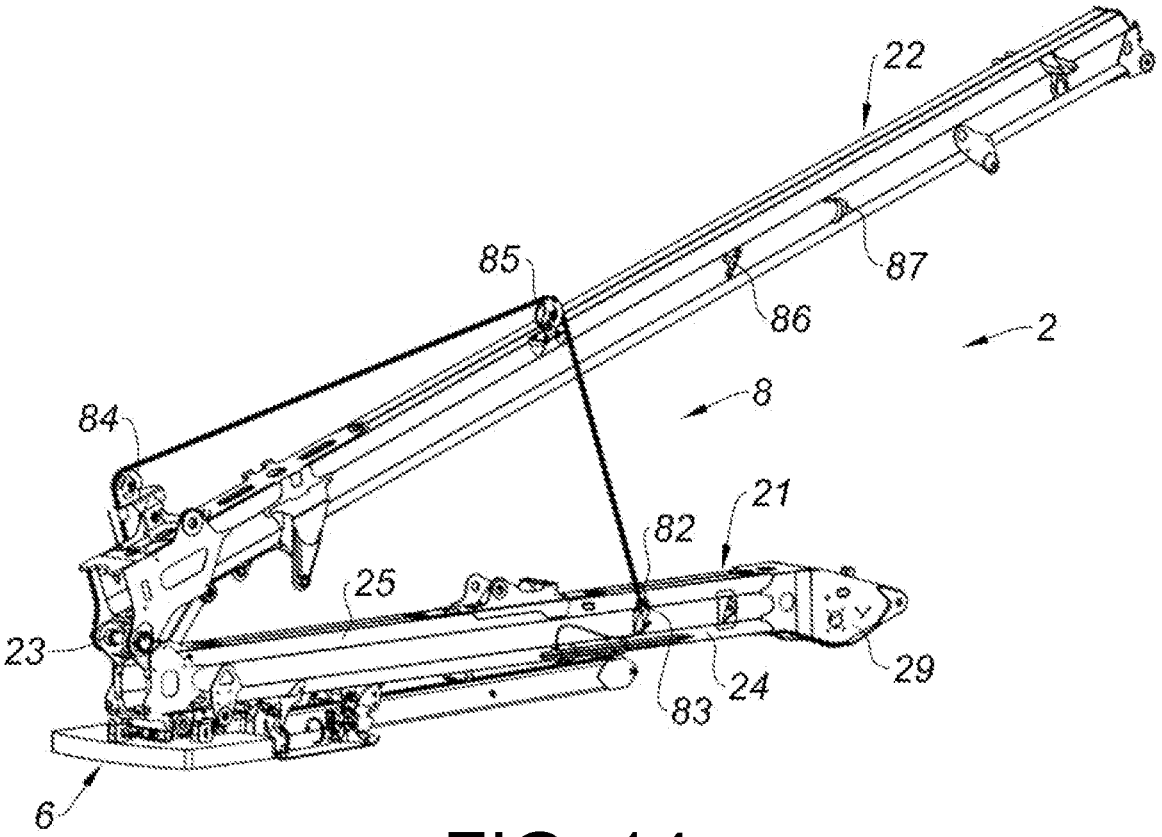
Figure 15:
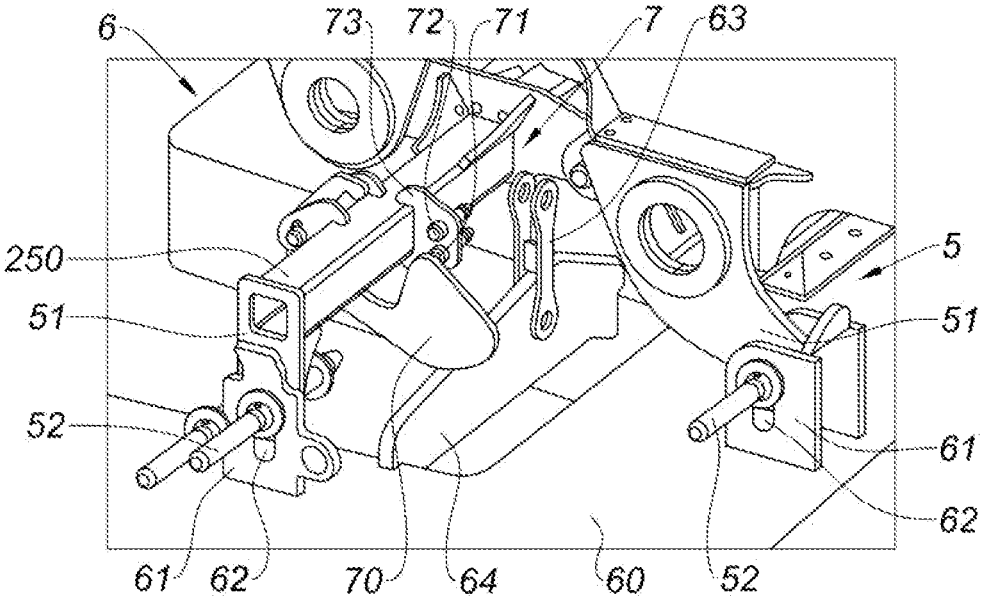
Figure 16:
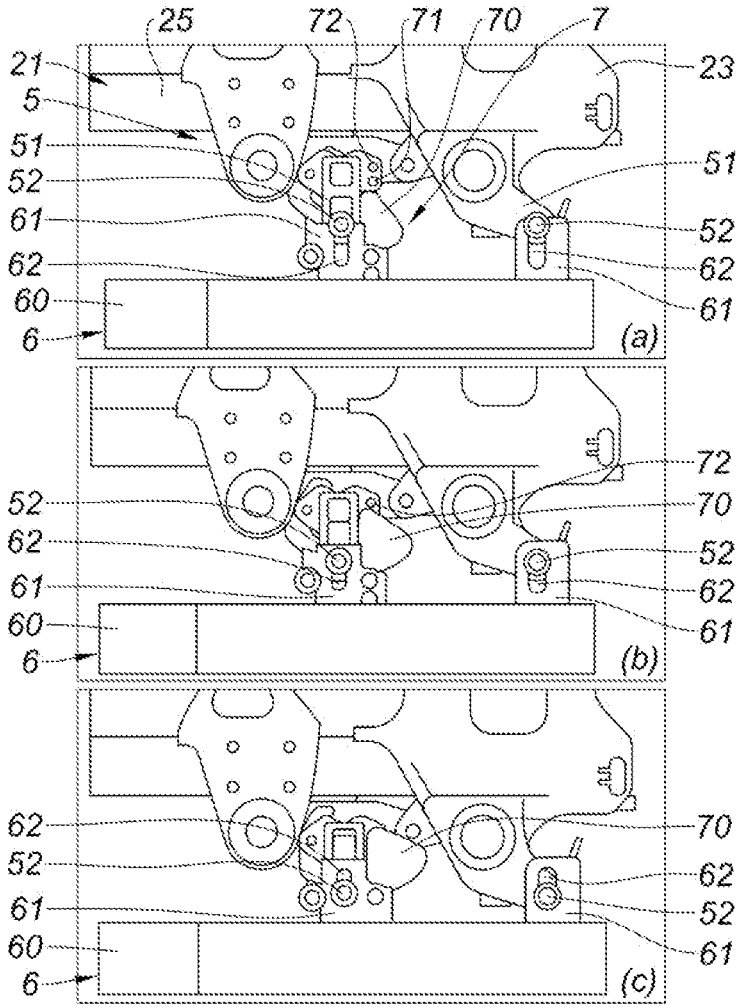
Figure 17:
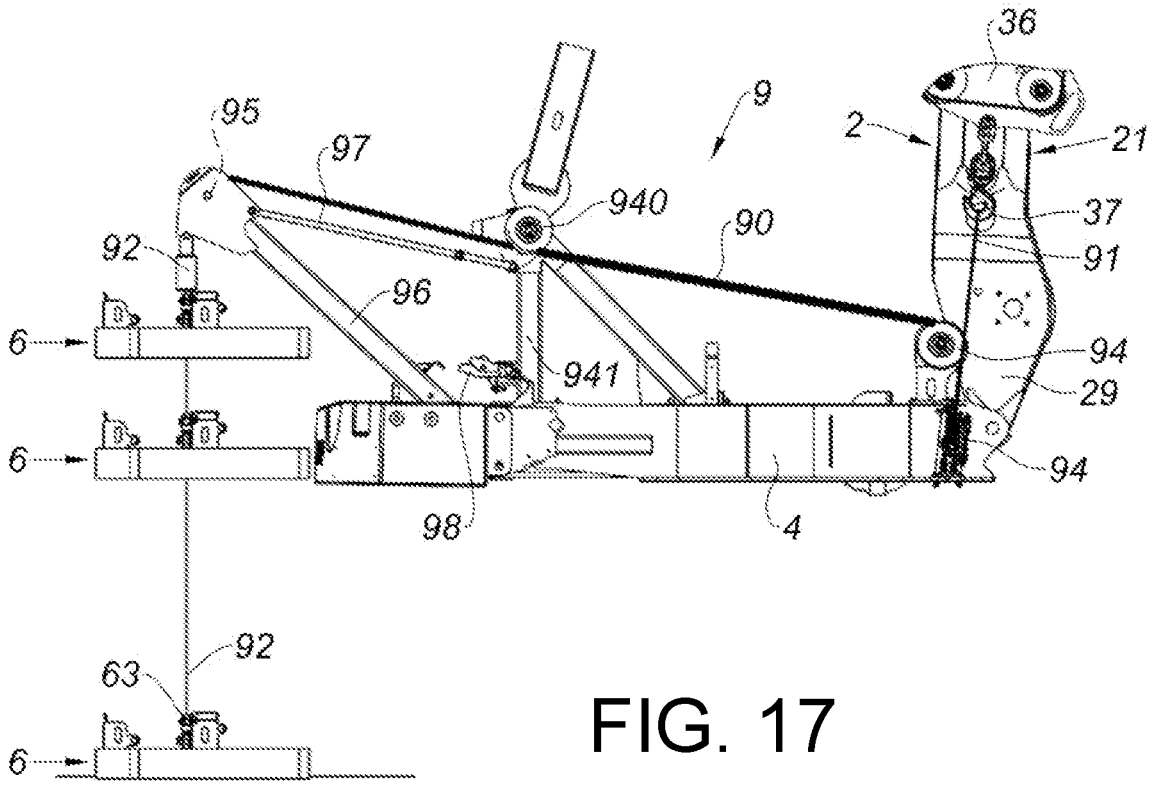
Figure 18:
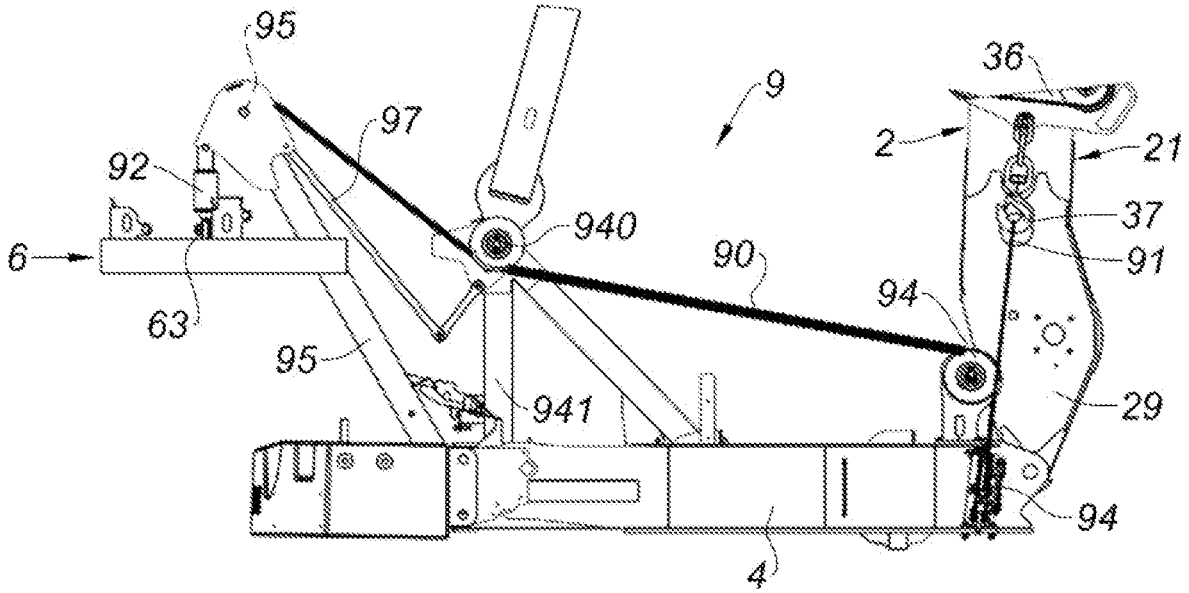
Figure 19:
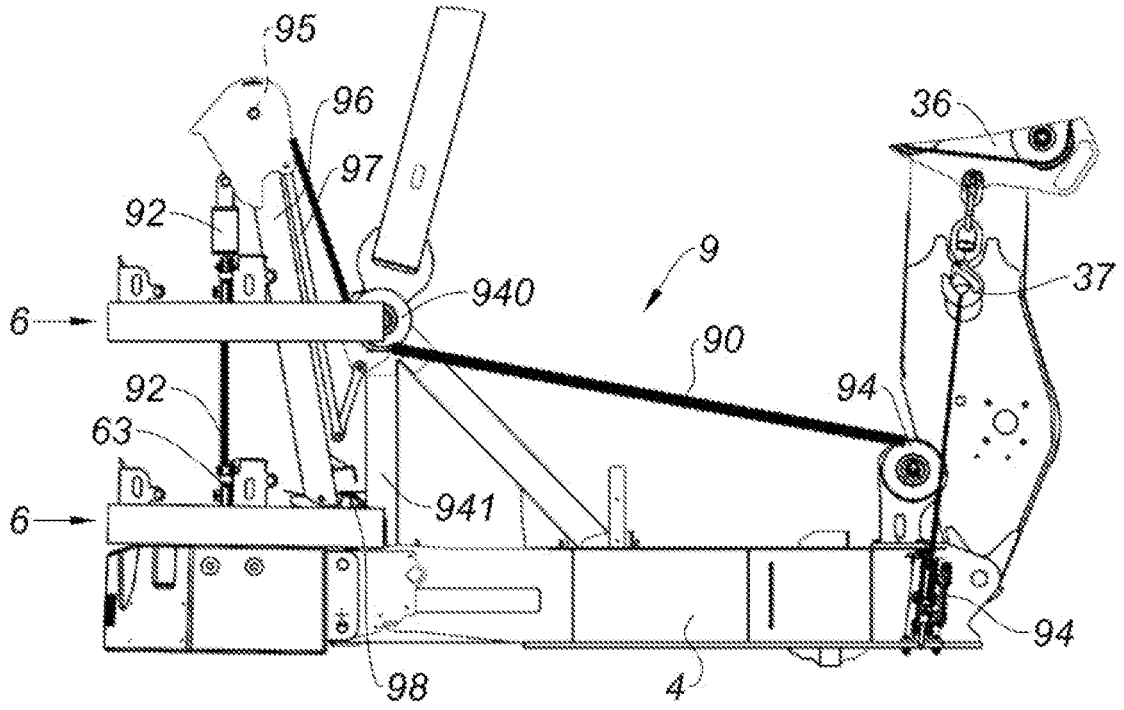

FIG. 10 is a schematic view of the mast of the crane of FIG. 1, in the transport configuration, with the removable ballasting element which is moored on the mast, and with the front lifting cable of the front auxiliary lifting system which is in a neutral configuration; and FIG. 11 is a schematic view of the mast of the crane of FIG. 1, in the same configuration as in FIG. 10, but from another point of view;

FIG. 12 is a schematic view of the mast of the crane of FIG. 1, in the transport configuration, with the moored removable ballasting element resting on the ground, and with the front lifting cable of the front auxiliary lifting system which is in a lifting configuration;

FIG. 13 is a schematic view of the mast of the crane of FIG. 1, in a lifting situation of the removable ballasting element from the ground to the mooring thereof on the mast by means of the front auxiliary lifting system, which follows a partial unfolding of the mast starting from the configuration of FIG. 12;

FIG. 14 is a schematic view of the mast of the crane of FIG. 1, in the same configuration as in FIG. 13, but from another point of view;

FIG. 15 is a schematic view of the removable ballasting element which is moored to the mooring system, by means of mooring elements, supports and locking pins, and with a visualization of the detection system;

FIG. 16 is a schematic view of the removable ballasting element during the mooring thereof on the mooring system, illustrating three successive positions of the removable ballasting element and the detection system;

FIG. 17 is a schematic view of portion of the rotating platform of the crane of FIG. 1, in a situation of lifting the removable ballasting element from the ground to a first raised position, by means of the auxiliary lifting system implementing a rear lifting cable which is fastened on the load lifting hook and passing through a jib arm;

FIG. 18 is a schematic view of the rotating platform of FIG. 17, still in a lifting situation of the removable ballasting element, after a first tilting of the jib arm, starting from the first raised position of FIG. 17; and FIG. 19 is a schematic view of the rotating platform of FIG. 18, still in a lifting situation of the removable ballasting element, after a second tilting of the jib arm starting from the situation of FIG. 18, to bringing the removable ballasting element to a second raised position, before its vertical descent to its final ballasting position on the rotating platform.

DETAILED DESCRIPTION

Figure 5:
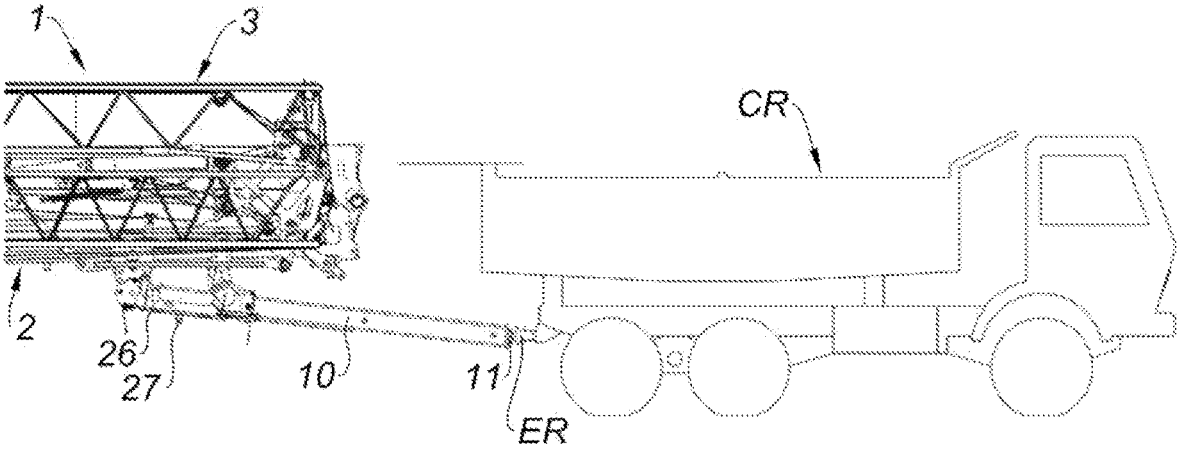
FIG. 5 is a schematic view of the front of the crane of FIG. 1, in a situation of transport on a drawbar, without mooring the removable ballasting element on the mast.
Figure 6:
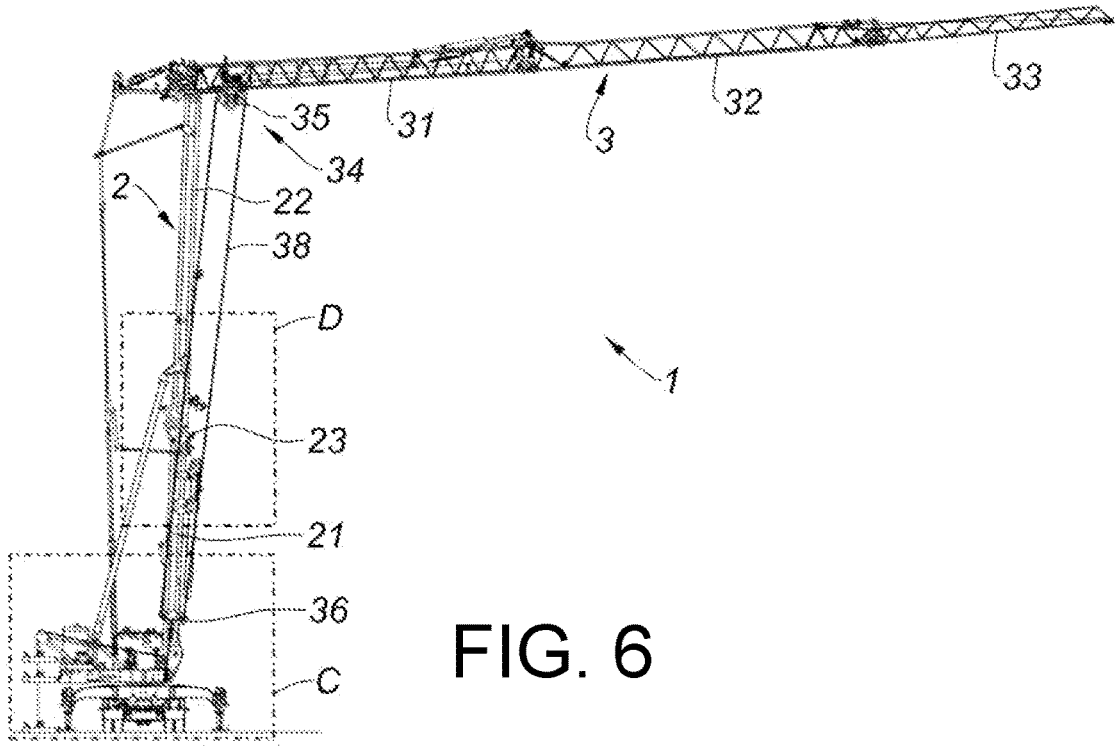
FIG. 6 is a schematic view of the crane of FIG. 1 in the working configuration, and hinged in a lifting situation of the removable ballasting element from the ground to the rotating platform by means of the rear auxiliary lifting system.
Figure 7:
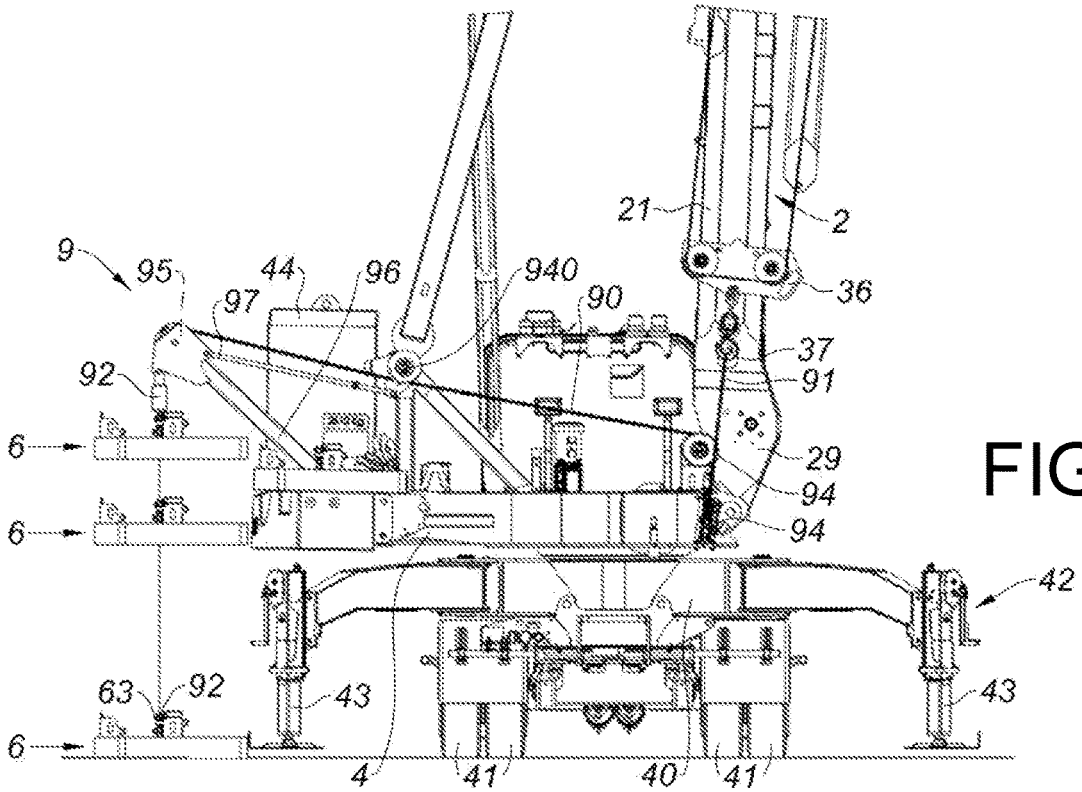
FIG. 7 is a zoomed schematic view on the area C of FIG. 6, to view the rotating platform stabilized on the ground and view the rear auxiliary lifting system.

With reference to the Figures, the following description relates to a self-erecting crane 1, hereinafter called crane 1, which comprises a mast 2 which is mounted on a rotating platform 4 and supporting a boom 3, wherein the crane 1 is configurable between:

- a transport configuration, illustrated in FIGS. 1 to 5, wherein the mast 2 and the boom 3 are folded back on themselves; and
- a working configuration, illustrated in FIG. 6, wherein the mast 2 and the boom 3 are unfolded.

The crane 1 thus comprises a folding/unfolding mechanism which acts on the mast 2 to fold and unfold the crane 1 and thus make it pass from the working configuration to the transport configuration, and vice versa.

The rotating platform 4 is pivotally mounted along a vertical axis on a chassis 40 resting, via a suspension device, on a single or double axle device supporting a set of wheels 41. A wedging system 42 is provided on the chassis 40 to bear on ground and take off the wheels in the working configuration. Such a wedging system 42 comprises several cylinders 43, such as for example hydraulic cylinders connected to a hydraulic power plant. Fixed ballasting elements 44 are permanently mounted on the rotating platform 4, insofar as they remain in place on the rotating platform 4 both in working configuration and in the transport configuration.

The mast 2 comprises, in turn:

- a lower mast segment 21 hinged on the rotating platform 4 by a lower hinge 29, and
- an upper mast segment 22 connected to the lower mast segment 21 by an intermediate articulation 23, wherein the boom 3 is hinged on this upper mast segment 22.

In the working configuration, the lower mast segment 21 and the upper mast segment 22 are vertical (to within plus or minus 5 degrees) in the extension of each other, with the upper mast segment 22 located above the lower mast segment 21. In the transport configuration, the lower mast segment 21 and the upper mast segment 22 are horizontal (to within plus or minus 5 degrees) and the upper mast segment 22 is folded over the lower mast segment 21.

Thus, the lower mast segment 21 has two opposite end portions 24, 25:

- a lower end portion 24 hinged on the rotating platform 4; and
- an upper end portion 25 on which the upper mast segment 22 is hinged via the intermediate hinge 23.

The boom 3 comprises, in turn, several crane segments, in this case three crane segments 31, 32, 33 in the illustrated example, with:

- a boom foot segment 31 hinged on the upper mast segment 22;
- a central boom segment 32 hinged on the boom foot segment 31; and
- a boom tip segment 33 hinged on the central boom segment 32.

In the working configuration, the three crane segments 31, 32, 33 are horizontal (to within plus or minus 5 degrees) in the extension of each other, with successively the boom foot segment 31, the central boom segment 32 and the boom tip segment 33. In the transport configuration the three crane segments 31, 32, 33 are also horizontal (to within plus or minus 5 degrees) with the boom foot segment 31 folded over (or next to) the lower mast segment 21, the central boom segment 32 folded over the boom foot segment 31 and finally the boom tip segment 33 folded over (or next to) the central boom segment 32.

The crane 1 also comprises a lifting device 34 configured to distribute, raise and lower a load along the boom 3, this lifting device 34 comprising a distributing trolley 35 suspended on the boom 3 and connected to a motorized distribution system (not illustrated) capable of displacing the distributing trolley 35 along the boom 3 in a forward direction and an opposite rearward direction (in order to load the load back and forth), and a block 36 supporting a load lifting hook 37 via a lifting cable 38 (in order to raise/lower the load); this lifting cable 38 being coupled to a motorized lifting system (not illustrated) to lower/raise the load lifting hook 37.

In order to be able to transport the crane 1, in the transport configuration, the mast 2 supports a hitch element 26 provided with a hitch shaft 27 suitable for being coupled on a fifth wheel SE provided on a rear platform PA of a tractor truck CT; which rear platform PA resting, via a suspension device, on a single or double axle device supporting a set of rear wheels RA.

Thus, the crane 1 can be the subject of a transport on a fifth wheel, as represented in FIG. 1, with the hitch shaft 27 coupled to the fifth wheel SE of the tractor truck CT. In the transport configuration, the rotating platform 4 and the chassis 40 are located at the rear of the mast 2, while the hitch element 26 is located at the front of the mast 2 in a front hitch area 28 which is dimensioned to come above the rear platform PA of the tractor truck CT for a transport on a fifth wheel. Thus, in the transport on a fifth wheel, the front hitch area 28 of the mast 2 is disposed vertically above the rotating platform 4.

This front hitch area 28 of the mast 2 corresponds to the upper end portion 25 of the lower mast segment 21, this upper end portion 25 being connected to the upper mast segment 22 opposite to the rotating platform 4 Thus, the hitch element 26 is fastened on this upper end portion 25 of the lower mast segment 21, with the hitch element 7 which is located on the underside of this upper end portion 25 in the transport configuration.

Moreover, the crane 1 also comprises a mooring system 5 which is also fastened on this upper end portion 25 of the lower mast segment 21, therefore in the front hitch area 28 of the mast 2, with this mooring system 5 which is located on the underside of this upper end portion 25 in the transport configuration. The function of this mooring system 5 is to temporarily moor a removable ballasting element 6 on the front hitch area 28 of the mast 2, under the mast 2, in the transport configuration. Thus, in the transport on a fifth wheel, the removable ballasting element 6 is fastened under the mast 2, above the rear platform PA of the tractor truck CT, such that this removable ballasting element 6 loads the set of rear wheels RA of the tractor truck CT and therefore contributes to improving the stability of the convoy on the road.

As will be discussed later, this removable ballasting element 6 can be detached from the mooring system 5, so that in the working configuration it can be mounted on the rotating platform 4, to increase the load capacity of the crane 1.

Figure 3:
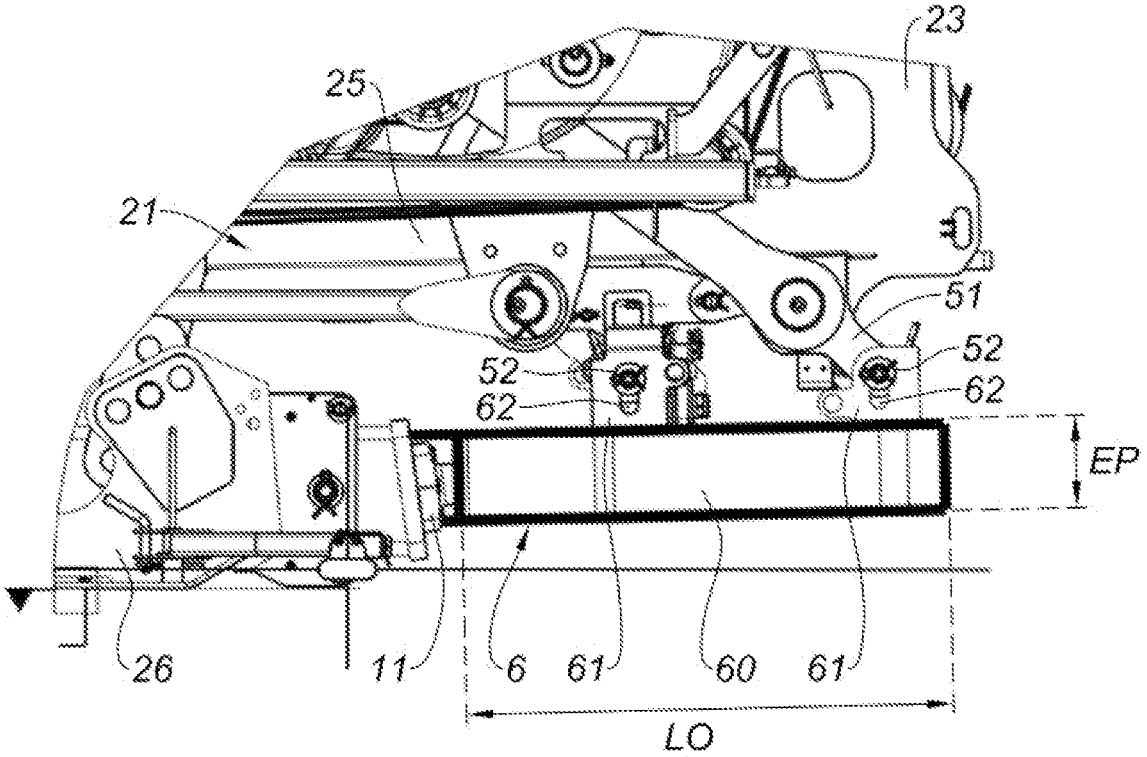
FIG. 3 is a zoomed schematic view on the area B of FIG. 2, to view the mooring of the removable ballasting element on the mast.
Figure 4:
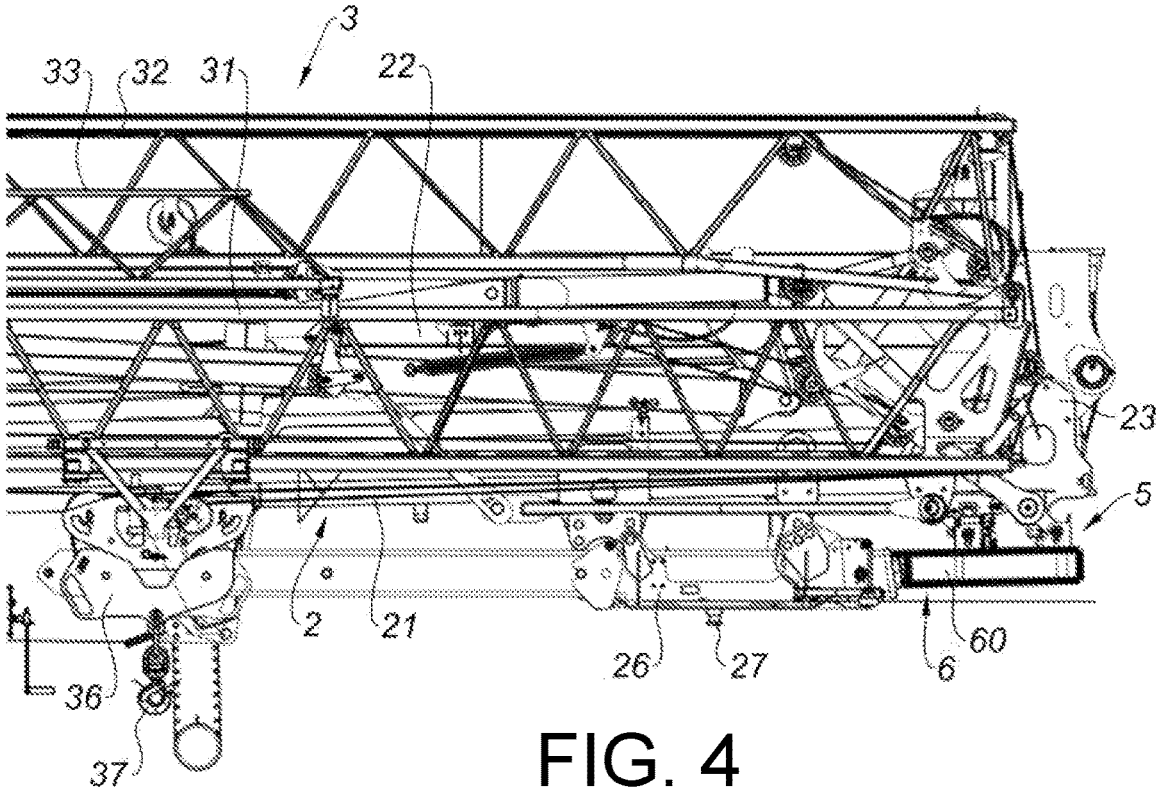
FIG. 4 is a schematic view of the front of the crane of FIG. 1 in the transport configuration.
Figure 8:
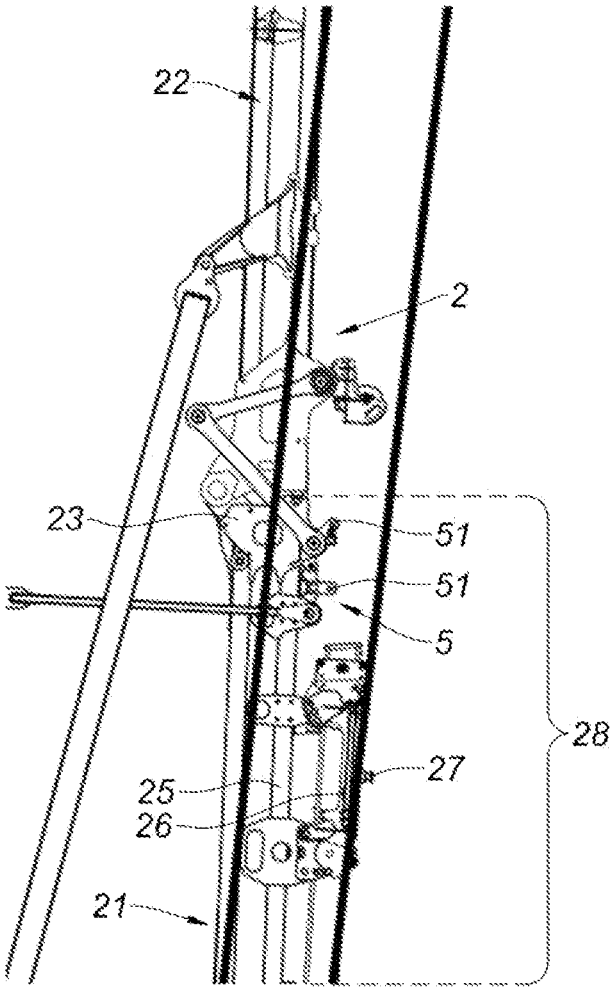
FIG. 8 is a zoomed schematic view on the area D of FIG. 6, to view the location of the hitch element and the mooring system when the crane is in the working configuration.
Figure 9:
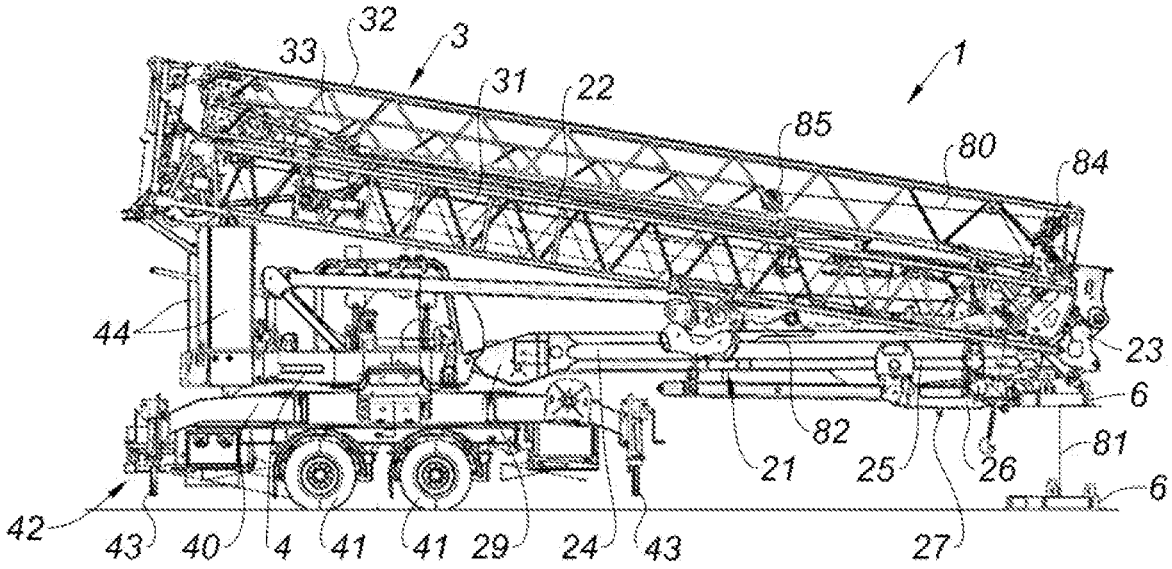
FIG. 9 is a schematic view of the crane of FIG. 1 in a situation of lifting the removable ballasting element from the ground to the mooring thereof on the mast by means of the front auxiliary lifting system, which implements a partial unfolding of the mast starting from the transport configuration.

In the illustrated example, the mooring system 5 is located in front of the hitch element 26 such that, in the transport configuration, the hitch element 26 is located between the rotating platform 4 and the removable ballasting element 6. As shown in FIG. 3, in the transport configuration, the mooring system 5 and the removable ballasting element 6 are located at least partially below the intermediate hinge 23 which is located at the front. Moreover, in the working configuration, and as shown in FIG. 8, the mooring system 5 is located above the hitch element 26, between the hitch element 26 and the intermediate hinge 23.

In a variant which is not illustrated, the mooring system is located behind the hitch element 26, while remaining in the front hitch area 28 of the mast 2, such that the removable ballasting element would be located between the rotating platform 4 and the hitch element 26.

The mooring system 5 is thus fastened on the upper end portion 25 of the lower mast segment 21, by being located on the underside of this upper end portion 25 in the transport configuration. Thus, during a transport on a fifth wheel, the removable ballasting element 6 is fastened below this upper end portion 25 of the lower mast segment 21 in the transport configuration.

The removable ballasting element 6 comprises a thin ballasting body 60, in the sense that this ballasting body 60, when moored to the mast 2 by means of the mooring system 5 in the transport configuration, has a thickness EP measured in a vertical direction, a length LO measured in a longitudinal direction from front to back, and a width measured in a transverse direction from right to left, wherein the thickness EP is less than the width and the length LO. This ballasting body 60 also has a general «U» shape, also called a horseshoe shape, with the opening of the «U» being rearward-facing.

This removable ballasting element 6 also comprises, protruding from an upper face of the ballasting body 60, mooring members 61 which are in the form of mooring legs and which are provided with respective lumens 62; these lumens 62 being oblong and vertical in the transport configuration. In the present case, the removable ballasting element comprises two mooring members 61 on the rear and a mooring member 61 on the front, with a symmetry on either side of a vertical median plane, this vertical median plane passing through the mooring member 61 at the front and passing between the two mooring members 61 at the rear.

The mooring system 5 comprises supports 51 suitable for supporting the respective mooring members 61 of the removable ballasting element 6, each support 51 being secured to the mast 2 and provided with a hole. The supports 51 are more specifically fastened on the upper end portion 25 of the lower mast segment 21.

Moreover, each mooring member 61 and support 51 assembly cooperates with a lock which is in the form of a locking pin 52 suitable for passing through the hole of the support 51 and the lumen 62 of the corresponding mooring member 61.

Thus, the removable ballasting element 6 can be configured between:

- a locked position wherein each locking pin 52 passes through both the concerned mooring member 61 and support 51 to moor the removable ballasting element 6 below the mast 2 in the transport configuration; and an unlocked position wherein each locking pin 52 is removed from the concerned mooring member 61 and support 51 to release the removable ballasting element 6 and thus to be able to unmoor the removable ballasting element 6.

in order to moor the removable ballasting element 6 to the mast 2, it is therefore sufficient to lift the removable ballasting element 6, from the ground, until the holes of the support 51 coincide with the lumens 62 of the respective mooring members 61, then to thread the locking pins 52 through the mooring members 61 and the supports 51, and finally to block the locking pins 52 so that they do not escape, using means suitable blocking means, such as nuts, bolts, ball locks, latches, circlips, etc.

In order to unmoor the removable ballasting element 6 from the mast 2, it is also sufficient to slightly lift the removable ballasting element 6, in order to be able to take off the locking pins 52 in order to be able to remove them, after having taken care to remove or unblock the associated blocking means.

In order to lift the removable ballasting element 6 (and also to lower it), the removable ballasting element 6 comprises at least one slinging member 63 for fastening a lifting cable adapted to lift the removable ballasting element 6 from the ground. Advantageously, the slinging member 63 is vertically aligned, during a lifting of the removable ballasting element 6, with the center of gravity of the removable ballasting element 6, so that the removable ballasting element 6 remains horizontal during the lifting (or lowering) thereof.

As shown in FIG. 15, the slinging member 63 is fastened on a cross member 64 which extends between the two branches of the «U» of the ballasting body 60; this ballasting body 60 having, as a reminder, a general «U» shape. The slinging member 63 is thus located in the vertical median plane which passes through the mooring member 61 at the front.

Moreover, the crane 1 comprises a detection system 7 which is disposed on the mast 2, at the mooring system 5, to detect, during a lifting of the removable ballasting element 6 from the ground to the mooring thereof on the mast 2 by cooperation with the mooring system 5, when the removable ballasting element 6 is positioned in a mooring position (illustrated in FIG. 16(*b*)) adapted so that the supports 51 can cooperate with the mooring members 61 and with the respective locking pins 52, in other words when the holes of the support 51 coincide with the lumens 62 of the respective mooring members 61.

Moreover, this detection system 7 is also provided to detect when the removable ballasting element 6 is positioned in an over-stroke position (illustrated in FIG. 16(*a*)) located vertically above the mooring position, to control an automatic lifting of the removable ballasting element 6.

With reference to FIGS. 15 and 16, this detection system 7 comprises a rocker arm 70 which is mounted so as to be rotatably movable on the mast 2, and more specifically movably mounted on a cross member 250 which is secured to the upper end portion 25 of the lower mast segment 21. This rocker arm 70 is provided to be pushed by the removable ballasting element 6 during the lifting thereof from the ground 6. In the embodiment which is illustrated in FIG. 15, the rocker arm 70 is pushed by the cross member 64 which supports the slinging member 63.

In the absence of a thrust exerted by the removable ballasting element 6 on the rocker arm 70, therefore when the removable ballasting element 6 is below the mooring position, the rocker arm 70 is in a rest position (or neutral position) shown in FIG. 16(*a*). An elastic return element may be provided which biases the rocker arm 70 towards the rest position, in the absence of a thrust exerted by the removable ballasting element 6, or alternatively the rocker arm 70 naturally returns to the rest position under the effect of its own weight.

In order to detect the mooring position, the detection system 7 comprises a mooring sensor 71 provided to detect the presence of the rocker arm 70 in a position corresponding to the mooring position of the removable ballasting element 6. This mooring sensor 71 is a presence detection sensor or proximity sensor, and is for example an optical sensor (without contact) or a mechanical sensor (with contact).

In order to detect the over-stroke position, the detection system 7 comprises an over-stroke sensor 72, disposed vertically above the mooring sensor 71, and provided to detect the presence of the rocker arm 70 in a position corresponding to the over-stroke position of the removable ballasting element 6.

The mooring sensor 71 and the over-stroke sensor 72 are for example both fastened to a plate 73 which is fastened on the cross member 250.

As shown in FIG. 16(*b*), the mooring position corresponds to a position wherein the holes of the supports 51 substantially coincide with the middle of the lumens 62 of the mooring members 61, thus allowing easily inserting the locking pins 62. In this mooring position, the removable ballasting element 6 has lifted the rocker arm 70 such that it is placed facing the mooring sensor 71, but not facing the over-stroke sensor 72 Thus, the mooring sensor 71 detects the rocker arm 70, and at the same time the over-stroke sensor 72 does not detect the rocker arm 70, which therefore allows the detection of the mooring position.

As shown in FIG. 16(*a*), when the holes of the support 51 substantially coincide with the upper ends of the lumens 62 of the mooring members 61, then the removable ballasting element 6 is still too low to push the rocker arm 70, which remains in the rest position, and in this case the rocker arm 70 is below the mooring sensor 71, and therefore necessarily also below the over-stroke sensor 72.

As shown in FIG. 16(*c*), the over-stroke position corresponds to a position wherein the holes of the supports 51 substantially coincide with the lower ends of the lumens 62 of the mooring members 61. In this over-stroke position, the removable ballasting element 6 has lifted the rocker arm 70 such that it is placed facing the mooring sensor 71 and also facing the over-stroke sensor 72. Thus, the mooring sensor 71 detects the rocker arm 70, and at the same time the over-stroke sensor 72 also detects the rocker arm 70, which therefore allows the detection of the over-stroke position.

Thus, when lifting the removable ballasting element 6 from the ground, the following phases are carried out to moor the removable ballasting element 6 to the mooring system 5:

slinging the removable ballasting element 6, in other words called hooking a lifting cable on the slinging member 63 of the removable ballasting element 6;

lifting of the removable ballasting element 6 until reaching the mooring position, detected by means of the detection system 7, and automatically stopping the lifting of the removable ballasting element 6 if the over-stroke position is reached;

pinning the locking pins 52, in other words called engagement of the locking pins 52 through the holes of the supports 51 and of the lumens 62 of the corresponding mooring members 61;

blocking of the locking pins 52;

lowering the removable ballasting element 6 until reaching the rest position, such that the locking pins 52 bear on the upper ends of the lumens 62 of the mooring members 61, as shown FIG. 16(*a*).

In order to lift the removable ballasting element 6 from the ground to the mooring system 5, it is conceivable to use an external lifting device, or alternatively to use a front auxiliary lifting system 8 which is described below with reference to FIGS. 9 to 14.

This front auxiliary lifting system 8 exploits the unfolding of the mast 2 to lift the removable ballasting element 6 from the ground. To do this, this front auxiliary lifting system 8 comprises a front lifting cable 80 which has:

a front end 81 adapted to be fastened on the slinging member 63 of the removable ballasting element 6; and a rear end 82 adapted to be fastened on a fixed point 83 provided on the lower mast segment 21.

Starting from the front end 81 to the rear end 82 thereof, this front lifting cable 80 passes through:

a first pulley 84 provided on the upper mast segment 22, wherein this first pulley 84 is located vertically above the mooring system 5 in the transport configuration; then go through a second pulley 85 also provided on the upper mast segment 22, wherein this second pulley 85 is remote from the first pulley 84 by a distance DI.

This front auxiliary lift system 8 is configurable in a neutral configuration, shown in FIGS. 10 and 11, wherein the front lifting cable 80 has:

the front end 81 thereof which is free, in particular by being stuck at the first pulley 84; and the rear end 82 thereof which is fastened on a neutral fixed point 86 provided on the upper mast segment 22 beyond the second pulley 85, after passing through an elbow 87 provided on the upper mast segment 22 beyond this neutral fixed point 86.

In this neutral configuration, the crane 1 can be folded/unfolded, be in the transport or working configuration, without the front auxiliary lifting system 8 interfering. The elbow 87 is provided to maintain a reserve of length for the front lifting cable 80, so that to be able to fasten the front end 81 thereof to the removable ballasting element 6.

This front auxiliary lifting system 8 is also configurable in a lifting configuration, illustrated in FIGS. 9 and 12 to 14, wherein the front lifting cable 80 has:

the front end 81 thereof which is fastened on the slinging member 63 of the removable ballasting element 6; and the rear end 82 thereof which is fastened on the fixed point 83.

The crane 1 being in the transport configuration, to switch from the neutral configuration to the lifting configuration, it is sufficient to unhook the rear end 82 from the neutral fixed point 86, then to remove the front lifting cable 80 from the elbow 87 to obtain the sufficient length to descend the front end 81 to the slinging member 63 of the removable ballasting element 6 resting on the ground, as well as shown in FIG. 12.

Once the front auxiliary lifting system 8 is in the lifting configuration, and starting from the transport configuration of the crane 1 (as illustrated in FIG. 12), it is necessary to control the folding/unfolding mechanism to make a partial unfolding of the mast 2 (starting from the transport configuration towards the working configuration), which allows the front lifting cable 80 to lift the removable ballasting element 6 from the ground to the mooring thereof on the mast 2.

Indeed, due to this partial unfolding of the mast 2, the second pulley 85 moves away from the fixed bridge 83, such that the first end 81 of the front lifting cable 80 approaches the first pulley 84 and therefore rises with the removable ballasting element 6, until the upper mast segment 22 forms with the lower mast segment 21 an angle AD (shown in FIG. 13) which is associated with the previously described mooring position; the mooring of the removable ballasting element 6 then taking place as previously described above.

As already indicated, in the working configuration, the removable ballasting element 6 is mounted on the rotating platform 4, to increase the load capacity of the crane 1. In order to lift the removable ballasting element 6 from the ground to on the rotating platform 4, it is conceivable to use an external lifting device, or alternatively to use a rear auxiliary lifting system 9 which is described below with reference to FIGS. 7 and 17 to 19.

This rear auxiliary lifting system 9 uses the load lifting hook 37, displaceable by means of the motorized lifting system, to lift and displace the removable ballasting element 6 from the ground to the rotating platform 4. To do this, this rear auxiliary lifting system 9 comprises a rear lifting cable 90 which has:

a front end 91 adapted to be fastened on the load lifting hook 37; and a rear end 92 adapted to be fastened on the slinging member 63 of the removable ballasting element 6.

Starting from the front end 91 thereof to the rear end 92 thereof, this rear lifting cable 90 passes through:

two main front pulleys 94 provided on the rotating platform 40 and located at the front of the rotating platform 40 (in the vicinity of the lower hinge 29); then passes through a rear main pulley 940 also provided on the rotating platform 40 and located at the rear of the rotating platform 40, wherein this rear main pulley 940 is mounted in height on a fixed arm 941 which is fastened to the rotating platform 40; then passes through a secondary pulley 95 provided on a jib arm 96 which is hinged on the rotating platform 40 along a horizontal pivot axis, wherein a rod 97 is hinged between the jib arm 96 and the fixed arm 941.

When the rear auxiliary lifting system 9 is not used, the jib arm 96 is locked in a raised position, almost vertical, by means of a locking hook 98.

Thus, the lifting of the load lifting hook 37 (by driving the motorized lifting system of the crane 1) allows the rear lifting cable 90 to lift the removable ballasting element 6 from the ground to the rotating platform 40, and the jib arm 96 allows tilting the removable ballasting element 6 above the rotating platform 40, before lowering the removable ballasting element 6 still by means of the load lifting hook 37.

More specifically, and with reference to FIGS. 17 to 19, the lifting of the removable ballasting element 6 from the ground until resting on the rotating platform 40 takes place as follows, by means of the rear auxiliary lifting system 9:

the jib arm 96 is tilted backwards, in order to be located above the removable ballasting element 6 which rests on the ground, the rod 97 is then unfolded and straight in order to retain the jib arm 96 the rear end 92 of the rear lifting cable 90 is fastened on the slinging member 63 of the removable ballasting element 6, after having sufficiently lowered the load lifting hook 37;

the load lifting hook 37 is raised, by acting on the motorized lifting system, so that the removable ballasting element 6 rises vertically until the rear end 92 of the rear lifting cable 90 abuts on the jib arm 96 (as shown in FIG. 17);

the load lifting hook 37 continues to be raised, such that the rear end 92 of the rear lifting cable 90 tilts the jib crane 96 forward (as shown in FIG. 18) until substantially reaching a raised position, almost vertical (as shown in FIG. 19);

the load lifting hook 37 is stopped, and the locking hook 98 is placed to lock the jib arm 96 in the raised position;

the load lifting hook 37 is lowered, by acting on the motorized lifting system, such that the removable ballasting element 6 descends vertically until it rests on the rotating platform 4 (as shown on FIG. 19).

It should be noted that the crane 1 can, optionally, comprise a towing drawbar 10 which is mounted on the mast 2, and more specifically on the lower mast segment 21. This towing drawbar 10 has a hitch head 11 suitable for being coupled to a towing element ER of a tow truck CR (of the trailer type) as shown in FIG. 5.

This towing drawbar 10 is stowable and can therefore be:

in a retracted position, as shown in FIGS. 1 to 4 and 9, which is used during a transport on a fifth wheel or in the working configuration; and in a deployed position, as shown in FIG. 5, which is only used during a transport on a drawbar.

In the retracted position and when the removable ballasting element 6 is moored on the mast 2 by means of the mooring system 5, the hitch head 11 of the towing drawbar 10 is located facing the removable ballasting element 6, and even partially in the opening of the «U» which is rearwardly facing the ballasting body 60; this ballasting body 60 having, as a reminder, a general «U» shape. Also, during a transport on a drawbar, the removable ballasting element 6 cannot be moored on the mast 2 by means of the mooring system 5, and in this case it can for example be loaded into the tow truck CR.

The invention claimed is:

1. A self-erecting crane comprising a mast which is mounted on a rotating platform and supporting a boom, said self-erecting crane being configurable between a transport configuration wherein the mast and the boom are folded back on themselves, and a working configuration wherein the mast and the boom are unfolded, said mast supporting a hitch element provided with a hitch shaft suitable for being coupled on a fifth wheel provided on a rear platform of a tractor truck in the transport configuration, said rotating platform being located in the transport configuration at a rear of the mast while the hitch element is located at a front of the mast in a front hitch area which is dimensioned to come above the rear platform of the tractor truck for a transport on the fifth wheel, and wherein the rotating platform is mounted on a chassis supporting at least one set of wheels, wherein said self-erecting crane comprises a mooring system located on the front hitch area of the mast, such that the mooring system is located on an underside of the mast in the transport configuration, and wherein the self-erecting crane further comprises at least one removable ballasting element which is configured to be:

in the transport configuration, temporarily moored on the mast by means of the mooring system, so that said removable ballasting element is located under the mast in the front hitch area of the mast, and in the working configuration, mounted on the rotating platform.

2. The self-erecting crane according to claim 1, wherein the mooring system is located in front of the hitch element such that, in the transport configuration, the hitch element is located between the rotating platform and the removable ballasting element.

3. The self-erecting crane according to claim 1, wherein the mooring system is located behind the hitch element such that, in the transport configuration, the removable ballasting element is located between the rotating platform and the hitch element.

4. The self-erecting crane according to claim 1, wherein the mast comprises a lower mast segment which is hinged on the rotating platform, and an upper mast segment which is connected to the lower mast segment by an intermediate hinge, wherein in the working configuration, the lower mast segment and the upper mast segment are vertical in the extension of each other, and in the transport configuration, the lower mast segment and the upper mast segment are horizontal and the upper mast segment is folded back above the lower mast segment, wherein the front hitch area of the mast corresponds to an upper end portion of the lower mast segment, said upper end portion being connected to the upper mast segment opposite to the rotating platform, the hitch element and the removable ballasting element then being fastened below the upper end portion of the lower mast segment in the transport configuration.

5. The self-erecting crane according to claim 4, wherein, in the transport configuration, the removable ballasting element is located at least partially below the intermediate hinge which is located at the front of the mast.

6. The self-erecting crane according to claim 1, wherein the removable ballasting element comprises a thin ballasting body which when moored on the mast in the transport configuration, has a thickness measured in a vertical direction, a length measured in a longitudinal direction from front to back, and a width measured in a transverse direction from right to left, wherein the thickness is less than the width and the length.

7. The self-erecting crane according to claim 1, wherein, in the transport configuration, the removable ballasting element is disposed directly in front of the hitch element or directly behind the hitch element.

8. The self-erecting crane according to claim 1, wherein the removable ballasting element comprises at least one mooring member and the mooring system comprises at least one support suitable for supporting the at least one mooring member, said at least one support and said at least one mooring member cooperating with at least one lock, a lock of the at least one lock configurable between an unlocked position releasing a mooring member of the at least one mooring member from a support of the at least one support in order to be able to unmoor the removable ballasting element, and a locked position locking the mooring member to the support to moor the removable ballasting element on the mast in the transport configuration.

9. The self-erecting crane according to claim 8, wherein the at least one mooring member comprises at least two mooring members, the mooring members provided with respective lumens, and the mooring systcm at least one support comprises at least two supports, the supports suitable for cooperating with supporting the respective mooring members, the supports and the mooring members cooperating with respective locks of the at least one lock, and the locks comprise respective locking pins which, in the locked position, pass through the mooring members and the supports for mooring the removable ballasting element below the mast.

10. The self-erecting crane according to claim 9, wherein the lumens are oblong and vertical in the transport configuration.

11. The self-erecting crane according to claim 8, wherein a detection system is disposed on the mast to detect, during a lifting of the removable ballasting element from ground to the mooring thereof on the mast, when the removable ballasting element is positioned in a mooring position adapted so that the at least one support cooperates with the at least one mooring member and the at least one lock.

12. The self-erecting crane according to claim 11, wherein the detection system is provided to detect when the removable ballasting element is positioned in an over-stroke position located above the mooring position, to control an automatic stop of the lifting of the removable ballasting element.

13. The self-erecting crane according to claim 11, wherein the detection system comprises a rocker arm which is movably mounted on the mast and provided to be pushed by the removable ballasting element when lifting the removable ballasting element, and a mooring sensor provided to detect the presence of the rocker arm in a position corresponding to the mooring position of the removable ballasting element.

14. The self-erecting crane according to claim 11, wherein the detection system is provided to detect when the removable ballasting element is positioned in an over-stroke position located above the mooring position, to control an automatic stop of the lifting of the removable ballasting element, wherein the detection system comprises a rocker arm which is movably mounted on the mast and provided to be pushed by the removable ballasting element when lifting the removable ballasting element, and a mooring sensor provided to detect the presence of the rocker arm in a position corresponding to the mooring position of the removable ballasting element, and wherein the detection system comprises an over-stroke sensor, disposed above the mooring sensor and provided to detect the presence of the rocker arm in a position corresponding to the over-stroke position of the removable ballasting element.

15. The self-erecting crane according to claim 1, wherein the removable ballasting element comprises at least one slinging member for fastening a lifting cable adapted to lift the removable ballasting element from ground.

16. The self-erecting crane according to claim 15, wherein the slinging member is vertically aligned, when lifting the removable ballasting element, with the center of gravity of the removable ballasting element.

17. The self-erecting crane according to claim 1, wherein the mast comprises a lower mast segment which is hinged on the rotating platform, and an upper mast segment which is connected to the lower mast segment by an intermediate hinge, wherein in the working configuration, the lower mast segment and the upper mast segment are vertical in the extension of each other, and in the transport configuration, the lower mast segment and the upper mast segment are horizontal and the upper mast segment is folded back above the lower mast segment, wherein the front hitch area of the mast corresponds to an upper end portion of the lower mast segment, said upper end portion being connected to the upper mast segment opposite to the rotating platform, the hitch element and the removable ballasting element then being fastened below the upper end portion of the lower mast segment in the transport configuration, and wherein the removable ballasting element comprises at least one slinging member for fastening a lifting cable adapted to lift the removable ballasting element from ground, the self-erecting crane further comprising a front auxiliary lifting system provided to lift the removable ballasting element from the ground to the mooring thereof on the mast, said front auxiliary lifting system comprising a front lifting cable which has a front end adapted to be fastened on the slinging member of the removable ballasting element, which passes through a first pulley provided on the upper mast segment, then which passes through a second pulley provided on the upper mast segment, and which ends in a rear end adapted to be fastened on a fixed point provided on the lower mast segment, such that a partial unfolding of the mast starting from the transport configuration to the working configuration allows the front lifting cable to lift the removable ballasting element from the ground to the mooring thereof on the mast.

18. The self-erecting crane according to claim 1, wherein the mast comprises a lower mast segment which is hinged on the rotating platform, and an upper mast segment which is connected to the lower mast segment by an intermediate hinge, wherein in the working configuration, the lower mast segment and the upper mast segment are vertical in the extension of each other, and in the transport configuration, the lower mast segment and the upper mast segment are horizontal and the upper mast segment is folded back above the lower mast segment, wherein the front hitch area of the mast corresponds to an upper end portion of the lower mast segment, said upper end portion being connected to the upper mast segment opposite to the rotating platform, the hitch element and the removable ballasting element then being fastened below the upper end portion of the lower mast segment in the transport configuration, and wherein the removable ballasting element comprises at least one slinging member for fastening a lifting cable adapted to lift the removable ballasting element from ground, the self-erecting crane further comprising a rear auxiliary lifting system provided to lift the removable ballasting element from the ground to the rotating platform, said rear auxiliary lifting system comprising a rear lifting cable which has a front end which is adapted to be fastened on a load lifting hook carried by the boom, which passes through at least one main pulley provided on the rotating platform, then which passes through a secondary pulley provided on a jib arm hinged on the rotating platform, and which ends in a rear end which is adapted to be fastened to the slinging member of the removable ballasting element, such that a lifting of the load lifting hook allows the rear lifting cable to lift the removable ballasting element from the ground to the rotating platform.

19. A transport method for transporting a self-erecting crane according to claim 1, the transport method comprising the following steps of:

starting from the working configuration, folding back the self-erecting crane into the transport configuration;

removing the removable ballast element which is initially mounted on the rotating platform during the working configuration;

mooring the removable ballast element on the front hitch area of the mast by means of the mooring system;

coupling the hitch shaft of the hitch element on the fifth wheel of the tractor truck, said fifth wheel being provided on the rear platform of the tractor truck, the rear platform resting on at least one set of rear wheels, such that the removable ballasting element, located on the front hitch area of the mast, is disposed above the rear platform of the tractor truck.

20. The transport method according to claim 19, wherein the removable ballasting element comprises at least one mooring member and the mooring system comprises at least one support suitable for supporting the at least one mooring member, said at least one support and said at least one mooring member cooperating with at least one lock, a lock of the at least one lock configurable between an unlocked position releasing a mooring member of the at least one mooring member from a support of the at least one support in order to be able to unmoor the removable ballasting element, and a locked position locking the mooring member to the support to moor the removable ballasting element on the mast in the transport configuration, and the step of mooring the removable ballast element comprises a lifting of the removable ballasting element from the ground to the mooring thereof on the mast by a cooperation of the at least one lock with the at least one mooring member.

21. The transport method according to claim 20, wherein the mast comprises a lower mast segment which is hinged on the rotating platform, and an upper mast segment which is connected to the lower mast segment by an intermediate hinge, wherein in the working configuration, the lower mast segment and the upper mast segment are vertical in the extension of each other, and in the transport configuration, the lower mast segment and the upper mast segment are horizontal and the upper mast segment is folded back above the lower mast segment, wherein the front hitch area of the mast corresponds to an upper end portion of the lower mast segment, said upper end portion being connected to the upper mast segment opposite to the rotating platform, the hitch element and the removable ballasting element then being fastened below the upper end portion of the lower mast segment in the transport configuration, wherein the removable ballasting element comprises at least one slinging member for fastening a lifting cable adapted to lift the removable ballasting element from ground, and wherein the self-erecting crane comprises a front auxiliary lifting system provided to lift the removable ballasting element from the ground to the mooring thereof on the mast, said front auxiliary lifting system comprising a front lifting cable which has a front end adapted to be fastened on the slinging member of the removable ballasting element, which passes through a first pulley provided on the upper mast segment, then which passes through a second pulley provided on the upper mast segment, and which ends in a rear end adapted to be fastened on a fixed point provided on the lower mast segment, such that a partial unfolding of the mast starting from the transport configuration to the working configuration allows the front lifting cable to lift the removable ballasting element from the ground to the mooring thereof on the mast, and the lifting of the removable ballasting element takes place as follows:

fastening the rear end of the front lifting cable on the fixed point provided on the lower mast segment;

placing the front lifting cable on the first pulley and the second pulley which are provided on the upper mast segment;

fastening the front end of the front lifting cable on the slinging member of the removable ballasting element which is resting on the ground;

partial unfolding of the mast starting from the transport configuration to the working configuration, so that the front lifting cable lifts the removable ballasting element.

22. The transport method according to claim 19, wherein the removable ballasting element comprises at least one mooring member and the mooring system comprises at least one support suitable for supporting the at least one mooring member, said at least one support and said at least one mooring member cooperating with at least one lock, a lock of the at least one lock configurable between an unlocked position releasing a mooring member of the at least one mooring member from a support of the at least one support in order to be able to unmoor the removable ballasting element, and a locked position locking the mooring member to the support to moor the removable ballasting element on the mast in the transport configuration, and a detection system is disposed on the mast to detect, during a lifting of the removable ballasting element from ground to the mooring thereof on the mast, when the removable ballasting element is positioned in a mooring position adapted so that the at least one support cooperates with the mooring member(s) at least one mooring member and the at least one lock, and the lifting of the removable ballasting element takes place at least until the detection system detects when the removable ballasting element is positioned in the mooring position.

23. The transport method according to claim 22, wherein the detection system is provided to detect when the removable ballasting element is positioned in an over-stroke position located above the mooring position, to control an automatic stop of the lifting of the removable ballasting element, and the lifting of the removable ballasting element is automatically stopped when the detection system detects when the removable ballasting element is positioned in the over-stroke position.

* * * * *